US009422045B2

(12) United States Patent
Kinpara et al.

(10) Patent No.: US 9,422,045 B2
(45) Date of Patent: Aug. 23, 2016

(54) OPERATING DEVICE OF ELECTRIC OUTBOARD MOTOR

(71) Applicant: SUZUKI MOTOR CORPORATION, Hamamatsu-shi, Shizuoka (JP)

(72) Inventors: Masatoshi Kinpara, Hamamatsu (JP); Yohei Nakano, Hamamatsu (JP); Satoru Takahashi, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 14/422,933

(22) PCT Filed: Jul. 22, 2013

(86) PCT No.: PCT/JP2013/069826

§ 371 (c)(1),
(2) Date: Feb. 20, 2015

(87) PCT Pub. No.: WO2014/034324

PCT Pub. Date: Mar. 6, 2014

(65) Prior Publication Data

US 2015/0232162 A1 Aug. 20, 2015

(30) Foreign Application Priority Data

Aug. 30, 2012 (JP) ..... 2012-189926

(51) Int. Cl.
*B63H 20/14* (2006.01)
*B63H 21/17* (2006.01)

(52) U.S. Cl.
CPC ..... *B63H 20/14* (2013.01); *B63H 21/17* (2013.01)

(58) Field of Classification Search
CPC ..... B63H 20/14; B63H 20/007
USPC ..... 440/6
See application file for complete search history.

(56) References Cited

U.S. PATENT DOCUMENTS 2,776,579 A 1/1957 Nichel, Jr.
3,820,641 A 6/1974 Borst et al.

(Continued)

FOREIGN PATENT DOCUMENTS

JP 58-141995 8/1983
JP 60-124399 8/1985

(Continued)

OTHER PUBLICATIONS

International Search Report dated Sep. 12, 2013, which issued during prosecution of International Application No. PCT/JP2013/069826, which corresponds to the present application.

(Continued)

*Primary Examiner* — Lars A Olson
*Assistant Examiner* — Jovon Hayes
(74) *Attorney, Agent, or Firm* — Troutman Sanders LLP

(57) ABSTRACT

An operating device of an electric outboard motor has a steering bar-shaped handle projecting forward and pivotally supported on a hull to be able to steer right and left. A propeller of the electric outboard motor is driven by an electric motor driven by power supplied from a power supply. On a tip portion of the steering bar-shaped handle, the operating device is provided with an accelerator grip that is made to pivot on an axial center normally and reversely from a neutral position to adjust an amount of power to be supplied to the electric motor according to a pivot amount. The operating device includes in the accelerator grip or in vicinity of the accelerator grip, an accelerator grip fixing mechanism that fixes a pivot position of the accelerator grip at the neutral position to be able to release a fixation easily.

5 Claims, 7 Drawing Sheets

(56) References Cited

U.S. PATENT DOCUMENTS

| | | | | |
|---|---|---|---|---|
| 5,437,206 | A | 8/1995 | Boor | |
| 6,406,342 | B1 * | 6/2002 | Walczak | B63H 20/10 440/84 |
| 6,902,450 | B2 * | 6/2005 | Ohtsuki | F02B 61/045 440/63 |
| 7,160,160 | B2 * | 1/2007 | Kojima | B63H 20/10 114/144 R |
| 7,214,113 | B2 * | 5/2007 | Kojima | B63H 21/213 440/87 |
| 7,331,834 | B2 * | 2/2008 | Yasuda | B63H 20/00 440/87 |
| 7,442,104 | B2 * | 10/2008 | Okabe | B63H 20/08 440/53 |
| 7,553,206 | B2 * | 6/2009 | Hasegawa | B63H 20/00 440/84 |
| 7,666,038 | B2 * | 2/2010 | Yomo | B63H 20/12 440/53 |
| 7,976,354 | B2 * | 7/2011 | Kubota | B63H 20/007 440/63 |
| 2004/0121667 | A1 | 6/2004 | Okabe | |
| 2009/0075532 | A1 | 3/2009 | Oishi et al. | |
| 2011/0244739 | A1 | 10/2011 | Daikoku et al. | |
| 2015/0232162 | A1 * | 8/2015 | Kinpara | B63H 21/17 440/6 |

FOREIGN PATENT DOCUMENTS

| | | |
|---|---|---|
| JP | S62-129397 U | 8/1987 |
| JP | 2004-189094 | 7/2004 |
| JP | 2009-234514 | 10/2009 |
| JP | 2009-255768 | 11/2009 |
| JP | 2011-052541 | 3/2011 |
| JP | 2011-213241 | 10/2011 |

OTHER PUBLICATIONS

International Preliminary Report on Patentability issued in corresponding PCT Application Serial No. PCT/JP2013/069826.

European Search Report dated Apr. 6, 2016, issued in corresponding Application No. 13833989.0.

* cited by examiner

OPERATING DEVICE OF ELECTRIC OUTBOARD MOTOR

CROSS-REFERENCE TO RELATED APPLICATIONS

This is a U.S. national phase application under 35 U.S.C. §371 of International Patent Application No. PCT/JP2013/069826, filed on Jul. 22, 2013, and claims benefit of priority to Japanese Patent Application No. 2012-189926, filed on Aug. 30, 2012. The International Application was published on Mar. 6, 2014, as International Publication No. WO 2014/034324 under PCT Article 21(2). The entire contents of these applications are hereby incorporated herein by reference.

TECHNICAL FIELD

The present invention relates to an operating device in an electric outboard motor designed to drive a propulsion propeller by an electric motor.

BACKGROUND ART

With regard to an outboard motor of this type, there is one described in Patent Literature 1, for example. In an operating device of this electric outboard motor, a steering bar-shaped handle projecting forward is provided, and this handle is pivotally supported on a hull to be able to steer right and left. Then, by an electric motor driven by power supplied from a battery, a propeller is driven, and on a tip portion of the steering bar-shaped handle, an accelerator grip that is made to pivot on an axial center normally and reversely from a neutral position to adjust an amount of power to be supplied to the electric motor according to a pivot amount is provided.

CITATION LIST

Patent Literature

Patent Literature 1: Japanese Laid-open Patent Publication No. 2009-234514

SUMMARY OF INVENTION

Technical Problem

As is the above-described example, an accelerator grip is made to pivot on an axial center normally or reversely from a neutral position, to thereby adjust a rotation direction and a rotation speed of a propeller. In an operating device having such a structure, there might be caused a "backward moving erroneous operation" that when returning the accelerator grip, for example, to the neutral position from a normal pivot position, the accelerator grip is made to pivot to a reverse pivot position passing through the neutral position erroneously, and if no measures are taken for it, smooth boat operation cannot be secured and it is not favorable. Further, the accelerator grip is formed to be able to pivot normally and reversely and is not provided with a regulating means of regulating pivots from a neutral position, so that there is also caused a risk that by accidental contact with the accelerator grip, the accelerator grip pivots to cause a boat to start to move erroneously.

In consideration of such circumstances, the present invention has an object to provide an operating device of an electric outboard motor that by accurate and smooth boat operation, secures high safety and also achieves extremely excellent operationality.

Solution to Problem

An operating device of an electric outboard motor according to the present invention is an operating device of an electric outboard motor designed that a steering bar-shaped handle projecting forward is provided and is pivotally supported on a hull to be able to steer right and left, a propeller is driven by an electric motor driven by power supplied from a power supply, and on a tip portion of the steering bar-shaped handle, an accelerator grip that is made to pivot on an axial center normally and reversely from a neutral position to adjust an amount of power to be supplied to the electric motor according to a pivot amount is provided, the operating device including: in the accelerator grip or in the vicinity of the accelerator grip, an accelerator grip fixing mechanism that fixes a pivot position of the accelerator grip at the neutral position to be able to release the fixation easily.

Further, the operating device of the electric outboard motor according to the present invention, in which the accelerator grip fixing mechanism includes: an engaging part of the accelerator grip; a locking piece that is formed to enable an engaging position where the locking piece projects from the tip portion of the steering bar-shaped handle to engage with the accelerator grip to make the accelerator grip incapable of pivoting and a releasing position where the engagement is released so as to enable the accelerator grip to pivot by going backward from the engaging position to appear and disappear easily; a biasing member that constantly biases the locking piece toward the engaging position side; and a lock releasing button that biases the locking piece toward the releasing position side to release the fixation of the accelerator grip.

Further, the operating device of the electric outboard motor according to the present invention, in which the lock releasing button in the accelerator grip fixing mechanism is projectingly provided on an outer peripheral surface of the accelerator grip and is formed to be able to project and sink easily in a radial direction of the accelerator grip.

Further, the operating device of the electric outboard motor according to the present invention, in which the lock releasing button in the accelerator grip fixing mechanism is disposed on a lower surface of the accelerator grip at the neutral position.

Further, the operating device of the electric outboard motor according to the present invention, in which the lock releasing button in the accelerator grip fixing mechanism is formed on a tip portion of the accelerator grip to be able to project and sink easily in an axial direction of the steering bar-shaped handle.

Advantageous Effects of Invention

According to the present invention, as long as a lock releasing button is not operated, an engagement state of an accelerator grip fixing mechanism is maintained, an accelerator grip does not start to move from its neutral position accidentally, unintended erroneous operations can be prevented securely, and high safety is guaranteed. On the other hand, lock release by the operation of the lock releasing button enables the accelerator grip to pivot to rotate an electric motor normally or reversely, thereby enabling a boat to move forward or backward. This operation can be performed easily and accurately by a boat operator by one hand, and is extremely excellent in operationality and usability.

DESCRIPTION OF EMBODIMENTS

Hereinafter, there will be explained preferable embodiments in an operating device of an electric outboard motor of the present invention based on the drawings.

Figure 1:
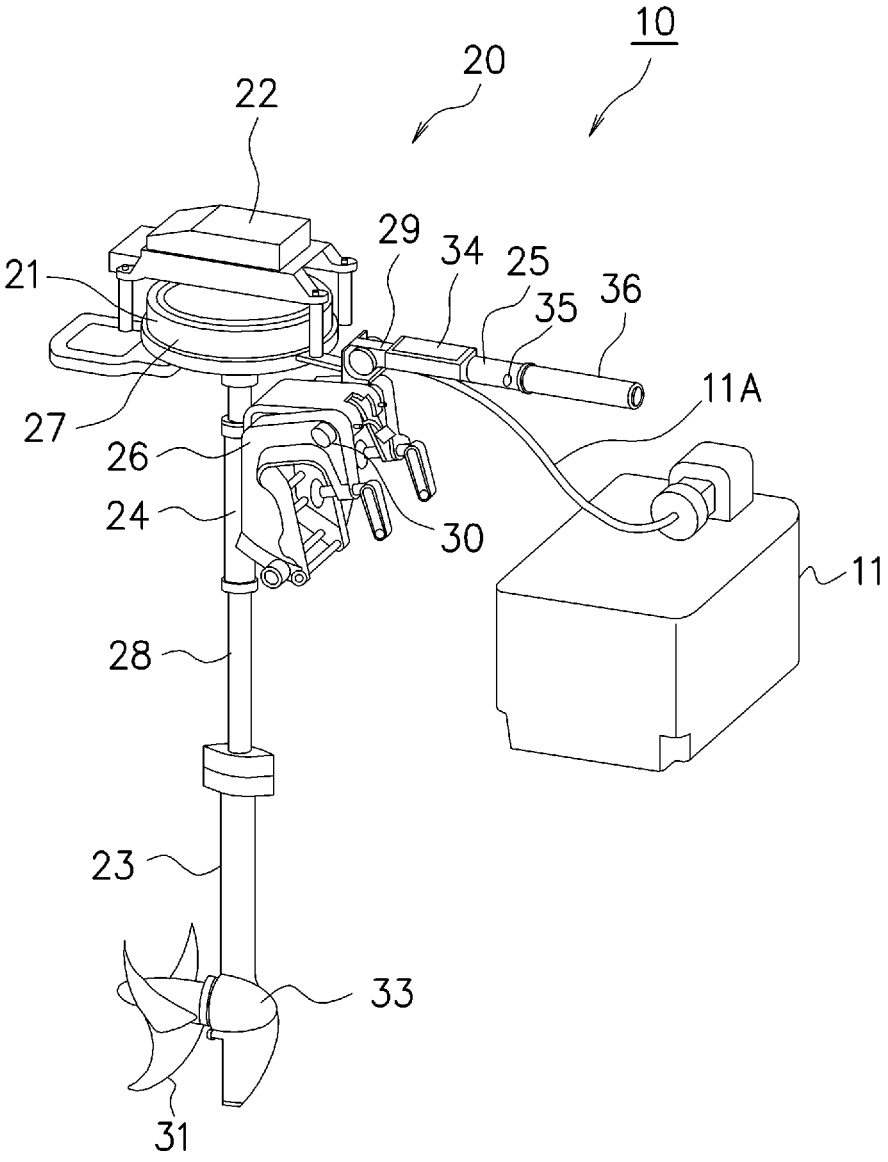
FIG. 1 is a perspective view illustrating a structure example of an electric outboard motor according to an embodiment of the present invention.
Figure 2:
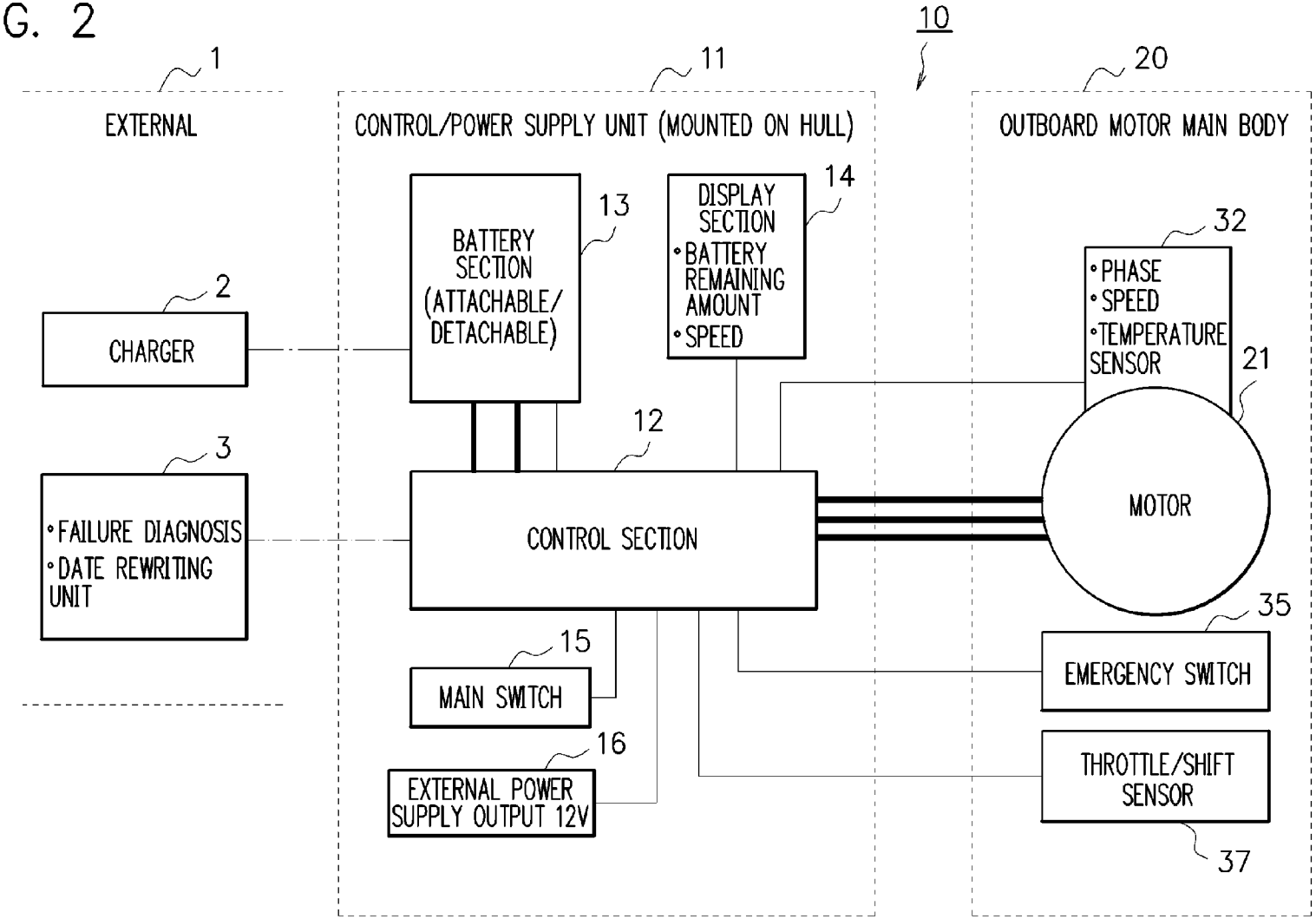
FIG. 2 is a block diagram illustrating a constitution example of the electric outboard motor according to the embodiment of the present invention.

FIG. 1 illustrates a structure example of an electric outboard motor 10 as an application example of the present invention. FIG. 2 is a block diagram illustrating a system constitution of the outboard motor 10. First, the overall structure of the outboard motor 10 will be explained by using FIG. 1 and FIG. 2. Incidentally, in the drawings to be used for the following explanation including FIG. 1, of the outboard motor 10, the front is indicated by an arrow Fr and the rear is indicated by an arrow Rr respectively, and further of the outboard motor 10, the lateral right side is indicated by an arrow R, and the lateral left side is indicated by an arrow L respectively according to need.

The outboard motor 10 has an outboard motor main body 20 and a control/power supply unit 11. The outboard motor main body 20 and the control/power supply unit 11 are constituted separately and the both are electrically connected by a connecting cable 11A. The outboard motor main body 20 is attached to a transom board or the like disposed at a stern of a not-illustrated boat to be used. The control/power supply unit 11 is mounted at an appropriate place of a hull of the boat to supply driving power, (which is a direct current, here), to the outboard motor main body 20 through the connecting cable 11A. Further, control/power supply unit 11 controls the outboard motor 10. Since the outboard motor main body 20 is separated from the control/power supply unit 11, it is possible to reduce weight of the outboard motor main body 20 and to achieve improvement in operationality of the outboard motor main body 20.

The control/power supply unit 11 includes: a control section 12 controlling the outboard motor 10; a battery section 13 as a power supply for the outboard motor 10; and a display section 14 displaying various parameters necessary for driving operation of the outboard motor 10 such as battery remaining amount and speed of the outboard motor 10 thereon.

The control section 12 has a memory capable of storing software and data on setting of the outboard motor 10 therein and a processor capable of reading the software and the setting of the outboard motor 10 from the memory to execute them. Then, the control section 12 executes the software based on the setting of the outboard motor 10, to thereby control the outboard motor 10. Incidentally, to the control section 12, a main switch 15, an external power supply output (for example, 12 V) 16, and the like are connected.

The battery section 13 includes: a single packaged battery pack or plural packaged battery packs (battery/batteries); and a battery pack attaching section to which plural batteries can be attached simultaneously, and is attachable/detachable to/from the control/power supply unit 11. The battery pack/packs of the battery section 13 is/are a direct-current power supply, can have a set of lithium ion battery cells, for example, applied thereto, and becomes/become charged by a charger 2 of an external device 1 to thereby be usable repeatedly. Then, the battery pack/packs is/are attached to the battery pack attaching section, and thereby power for driving the control section 12 and an electric motor of the outboard motor main body 20, or other respective sections can be supplied.

Next, the outboard motor main body 20 includes: an electric motor 21; an inverter 22; a propulsion part 23; a swivel bracket 24; a steering handle 25; a clamp bracket 26; and so on.

The electric motor 21 is coupled to a drive shaft housing 28 via a motor housing 27. The steering handle 25 is coupled to the motor housing 27 via a handle bracket 29. Incidentally, the steering handle 25 is attached to the handle bracket 29 to be able to fold in an up and down direction. Of the drive shaft housing 28, a portion close to an upper portion is coupled to the swivel bracket 24 to be able to pivot in a horizontal direction, and the electric motor 21, the inverter 22, the propulsion part 23, and the steering handle 25 can pivot in the horizontal direction on the swivel bracket 24 as one.

The clamp bracket 26 is coupled to the front side of the swivel bracket 24 via a tilt pin 30 bridged in a right and left direction. The clamp bracket 26 and the swivel bracket 24 can pivot relatively via the tilt pin 30. Thus, the outboard motor main body 20 is made to pivot on the tilt pin 30 in a state of the clamp bracket 26 being fixed to the transom board of the boat, thereby making it possible to perform a tilt-up operation in which the propulsion part 23 is brought up from the water.

Here, the electric motor 21 is a driving source for rotationally driving a propulsion propeller 31 of the propulsion part 23, and an alternating current motor such as a three-phase alternating current induction motor, for example, is applied thereto. In this case, a coil to generate a rotating magnetic field by an alternating current and a rotor to rotate by this rotating magnetic field are housed in the motor housing 27. A rotation output shaft to be provided to the rotor is provided so that its axial direction can be substantially vertical, and extends to the lower side of the motor housing 27.

The electric motor 21 has a substantially circular shape when seen in plan view in the axial direction of the rotation output shaft, and has a substantially flat shape whose radial direction dimension on the basis of the rotation output shaft is larger than the axial direction dimension. Such an electric motor having a large radial direction dimension has large torque when rotating at low speed in particular. Therefore, when the boat starts to move, and the like, large propulsive force can be obtained without using an intermediate speed reducer. Although the overall height is kept low and the structure is compact as the outboard motor main body 20, necessary and sufficient output can be obtained. Incidentally, to the electric motor 21, a sensor 32 that detects working parameters of phase, speed, temperature, and the like is added, as illustrated in FIG. 2, and detection signals of them are designed to be transmitted to the control section 12.

The inverter 22 converts the direct current supplied from the control/power supply unit 11 into an alternating current to supply it to the electric motor 21. The inverter 22 is provided so as to be stacked separately from the electric motor 21 in the up and down direction. In this case, in plan view from above, the right, the left, and the front end of the inverter 22 fit within the inside of a visible outline of the electric motor 21.

The propulsion part 23 converts rotation power of the electric motor 21 into propulsive force to the boat. In the propulsion part 23, a drive shaft (not illustrated) housed and supported in the drive shaft housing 28 is coupled to the propulsion propeller 31 via a gear in a gear case 33. Thus, the rotation power that the electric motor 21 generates is transmitted to the propulsion propeller 31 via the drive shaft and the gear in the gear case, and thereby the propulsion propeller 31 rotates. As described above, the electric motor 21 can output rotation power with high torque even at low speed, so that no speed reducer is required and the electric motor 21 and the drive shaft are directly coupled without a speed reducer interposed therebetween. Thus, it is possible to achieve downsizing, a reduction in weight or structure simplification of the propulsion part 23, and reducing the number of gears makes it possible to lower noise that the gear makes. Further, switching of normal rotation and reverse rotation of the propulsion propeller 31 (namely switching of headway and sternway of the boat) is performed by switching the rotation direction of the electric motor 21, so that a reversing gear such as an outboard motor to which an internal combustion engine is applied is not required.

Then, the steering handle 25 is a handle to be used by a boat operator for a steering operation of the present outboard motor 10, and constitutes a substantial part of an operating device of the present invention. The steering handle 25 is provided so as to extend forward from the electric motor 21. A base end portion of the steering handle 25 is fixed to a lower surface of a front end portion of the motor housing 27 via the handle bracket 29, and when a boat operator turns the steering handle 25 in a substantially horizontal direction, the electric motor 21 and the propulsion part 23 pivot in the substantially horizontal direction together with the steering handle 25, to thereby make it possible to perform the steering operation. The steering handle 25 is disposed immediately above the swivel bracket 24, so that a minimal length that makes the steering operation possible is obtained. Therefore, the height of the steering handle 25 and the height of the electric motor 21 substantially agree with each other.

On the steering handle 25, as illustrated in FIG. 1, a display part 34, an emergency switch 35, an accelerator grip 36, and the like are provided. The display part 34 can display information on the boat on which the outboard motor 10 and the external device 1 are mounted, such as battery remaining amount of the control/power supply unit 11, rotation speed of the electric motor 21, moving speed of the boat, and the like thereon. The emergency switch 35 is a switch for emergently stopping the outboard motor 10.

The accelerator grip 36 is to adjust the rotation direction and the rotation speed of the electric motor 21. The accelerator grip 36 is attached to a tip portion of the steering handle 25 to be able to pivot normally and pivot reversely on an axial center of the steering handle 25, and is designed that its pivotal directions and pivot amount are detected by a throttle/shift sensor 37 (FIG. 2). According to the pivot amount of the accelerator grip 36, the number of rotations of the electric motor 21 is set.

In the above-described case, the external device 1 further has a failure diagnosis/data rewriting unit 3. This failure diagnosis/data rewriting unit 3 is electrically connected to the control section 12 of the control/power supply unit 11 to be able to transmit/receive signals to/from the control section 12 of the control/power supply unit 11, to thereby be able to read the state of the outboard motor 10 to judge whether or not the outboard motor 10 is normal. Further, the failure diagnosis/data rewriting unit 3 can rewrite the software and the setting stored in the memory of the control section 12.

Figure 3:
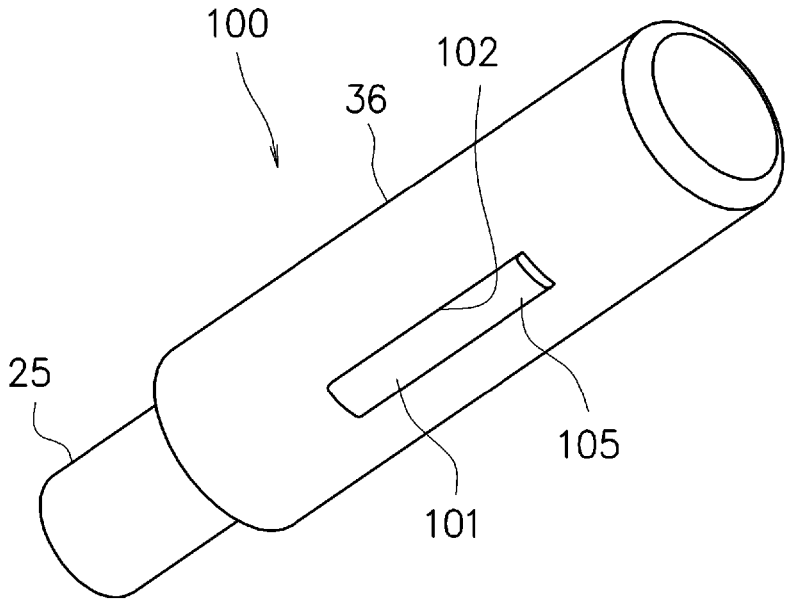
FIG. 3 is a perspective view illustrating a substantial part structure example of an operating device of the electric outboard motor according to the embodiment of the present invention.
Figure 4:
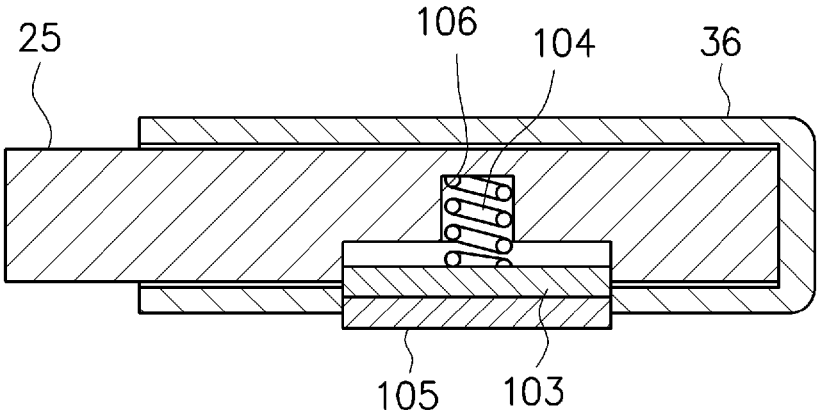
FIG. 4 is a cross-sectional view illustrating the substantial part structure example of the operating device of the electric outboard motor according to the embodiment of the present invention.

FIG. 3 and FIG. 4 each illustrate a substantial part structure example of an operating device 100 of the outboard motor according to the present invention. Particularly, the operating device 100 has, in the accelerator grip 36 or in the vicinity of the accelerator grip 36, an accelerator grip fixing mechanism 101 that fixes a pivot position of the accelerator grip 36 at a neutral position of the accelerator grip 36 to be able to release the fixation easily.

In a concrete structure of the accelerator grip fixing mechanism 101, a key groove 102 being an engaging part of the accelerator grip 36, a key 103 being a locking piece that is formed to enable an engaging position where the key 103 projects from the steering handle 25 to engage with the accelerator grip 36 to make the accelerator grip 36 incapable of pivoting and a releasing position where the engagement is released so as to enable the accelerator grip 36 to pivot by going backward from this engaging position to appear and disappear easily, a spring 104 being a biasing member that constantly biases the key 103 toward the engaging position, and a switch 105 being a lock releasing button that biases the key 103 toward the releasing position to release the fixation of the accelerator grip 36 are provided.

Figure 5A:
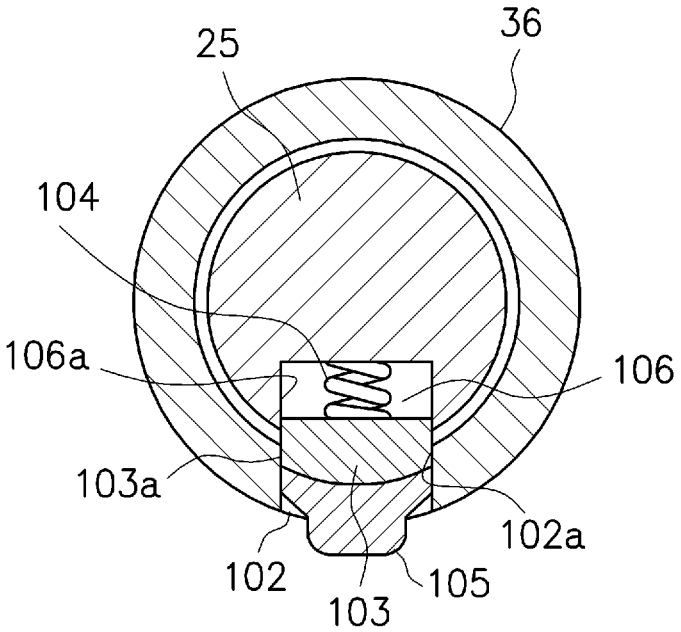
FIG. 5A is a cross-sectional view illustrating a working example in the operating device of the electric outboard motor according to the embodiment of the present invention.
Figure 5B:
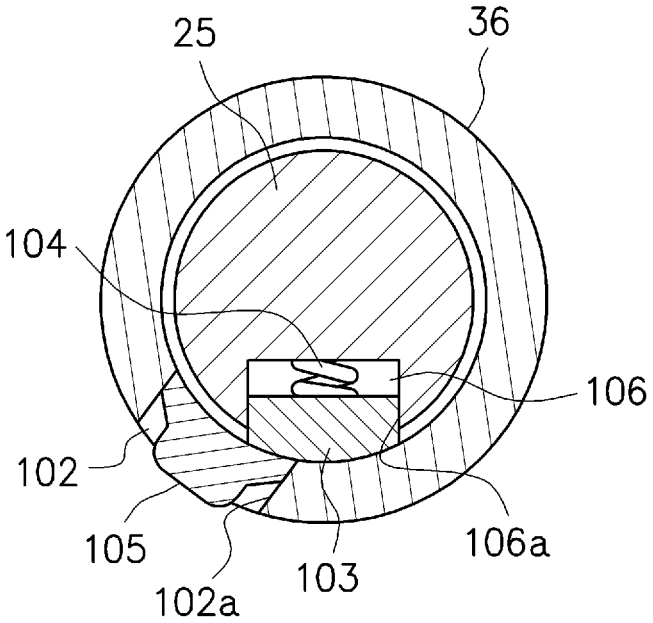
FIG. 5B is a cross-sectional view illustrating a working example in the operating device of the electric outboard motor according to the embodiment of the present invention.

With reference also to FIG. 5A and FIG. 5B, the key groove 102 is formed so as to obtain a depth in a radial direction of the accelerator grip 36 in the neutral portion of the steering handle 25 and the accelerator grip 36 along the axial direction of the accelerator grip 36. The key 103 is housed in the key groove 102 so as to fit therein "completely" without rattling, and can move in the radial direction in the key groove 102. When in neutral, as illustrated in FIG. 5A, side surfaces 103*a* of the key 103 are designed to engage with inner walls 102*a* of the key groove 102.

Also in the steering handle 25, a key groove 106 matching the key groove 102 is formed. The key 103 can move in the radial direction in the key groove 106. When in neutral, as illustrated in FIG. 5A, the side surfaces 103*a* of the key 103 are designed to engage also with inner walls 106*a* of the key groove 106. The spring 104 is fitted in the key groove 106 to bias the key 103 outward in the radial direction. The switch 105 is housed in the key groove 102 to be movable in the radial direction, is projectingly provided on an outer peripheral surface of the accelerator grip 36, and is formed to be able to project and sink easily in the radial direction of the accelerator grip 36. Incidentally, a not-illustrated stopper is provided for the switch 105 in order to prevent the switch 105 from going out of the accelerator grip 36 and projecting.

Further, in this example, the switch 105 is disposed so as to be positioned on the lower surface of the accelerator grip 36 when in neutral.

In the above-described structure, when in neutral, as illustrated in FIG. 3 to FIG. 5A, the side surfaces 103*a* of the key 103 engage with both the inner walls 102*a* of the key groove 102 and the inner walls 106*a* of the key groove 106. Since the key 103 is biased outward in the radial direction by resilient force of the spring 104, as long as the switch 105 is not operated, the engagement state of the accelerator grip fixing mechanism 101 is maintained, namely the accelerator grip 36 is fixed to a lock state. Thereby, the accelerator grip 36 does not start to move from the neutral position accidentally and unintended erroneous operations (for example, erroneous start and the like) can be prevented securely, resulting in that high safety is guaranteed.

On the other hand, when the switch 105 is pressed in against the resilient force of the spring 104, as illustrated in FIG. 5B, the side surfaces 103*a* of the key 103 are detached from the inner walls 102*a* of the key groove 102 and the engagement of the both is released. This lock release enables the accelerator grip 36 to pivot, and when the accelerator grip 36 pivots in a predetermined one direction or the other direction in this lock release state, the electric motor 21 is normally rotated or reversely rotated to enable the boat to move forward or backward.

When the accelerator grip 36 is returned to the neutral position from a normal pivot or reverse pivot position, by the resilient force of the spring 104, the key 103 engages with the key groove 102 by itself at the neutral position and the accelerator grip 36 is fixed to the lock state again. As above, the accelerator grip 36 is returned to the neutral position by itself, so that it is possible to extremely easily and securely perform determination of the neutral position. In this case, there is no case that the accelerator grip 36 pivots passing through the neutral position, and the accelerator grip 36 stops at the neutral position definitely, so that erroneous operations such as an accidental pivot in the opposite direction can be prevented.

Figure 6A:
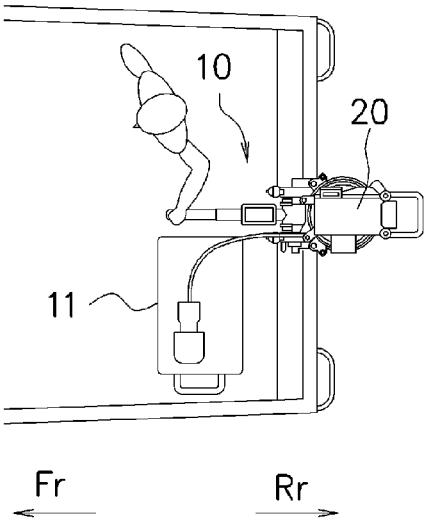
FIG. 6A is a top view of an outboard motor mounted boat illustrating a manipulation example of the operating device of the electric outboard motor according to the embodiment of the present invention in relation to a comparative example.

Further, the switch 105 is projectingly provided on the outer peripheral surface of the accelerator grip 36, and is formed to be able to project and sink easily in the radial direction of the accelerator grip 36. Thereby, as illustrated in FIG. 6A, for example, a boat operator can perform the operation of the accelerator grip fixing mechanism 101 by one hand in a state of gripping the accelerator grip 36 and can perform an accelerator operation in this state, so that the boat operation is facilitated extremely.

Figure 6B:
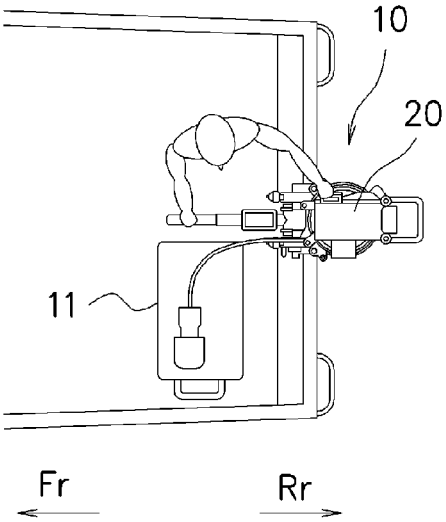
FIG. 6B is a top view of an outboard motor mounted boat illustrating a manipulation example of the operating device of the electric outboard motor according to the embodiment of the present invention in relation to a comparative example.

Incidentally, if a locking mechanism of the accelerator grip 36 exists on the outboard motor main body 20 side, the boat operator has to operate the locking mechanism with both hands as illustrated in FIG. 6B. Therefore, it is not necessarily easy to obtain good operationality.

Figure 6C:
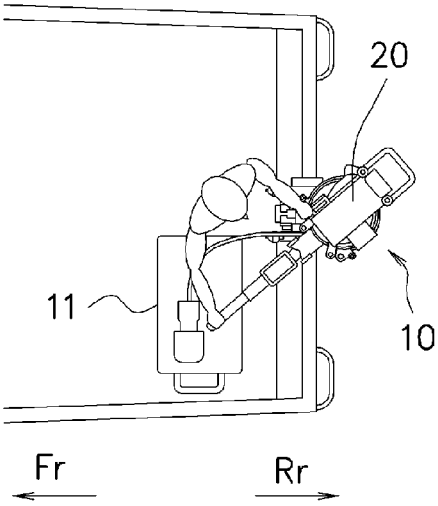
FIG. 6C is a top view of an outboard motor mounted boat illustrating a manipulation example of the operating device of the electric outboard motor according to the embodiment of the present invention in relation to a comparative example.

Further, if the locking mechanism exists on the outboard motor main body 20 side as described above, on the occasion of performing a steering operation, as illustrated in FIG. 6C, the operationality becomes further difficult.

Further, the switch 105 is disposed so as to be positioned on the lower surface of the accelerator grip 36 when in neutral.

Here, it is common for the boat operator to grip the accelerator grip 36 so as to cover it from above at the time of operating the boat normally. At that time, finger tips of the boat operator are positioned on the outer peripheral lower surface of the accelerator grip 36, and while gripping the accelerator grip 36 without having to grip it again at the time of a lock releasing operation, the boat operator can perform the operation easily by fingers in this state. Further, since the switch 105 being a lock releasing button is on the lower surface of the accelerator grip 36, there is also no case that the switch 105 is operated unintentionally.

Figure 7:
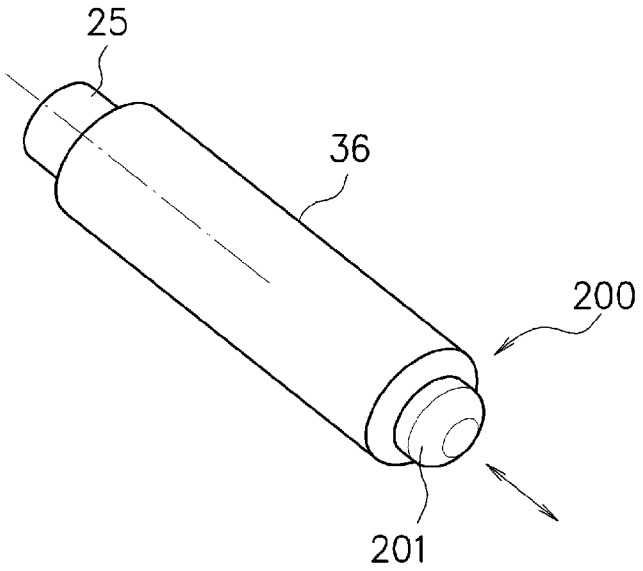
FIG. 7 is a perspective view illustrating a substantial part structure example of an operating device of an electric outboard motor according to a second embodiment of the present invention.

FIG. 7 illustrates a substantial part structure example of an operating device 200 of an outboard motor according to a second embodiment of the present invention. Particularly, the operating device 200 has, in an accelerator grip 36 or in the vicinity of the accelerator grip 36, an accelerator grip fixing mechanism 201 that fixes a pivot position of the accelerator grip 36 at a neutral position of the accelerator grip 36 to be able to release the fixation easily.

Figure 8:
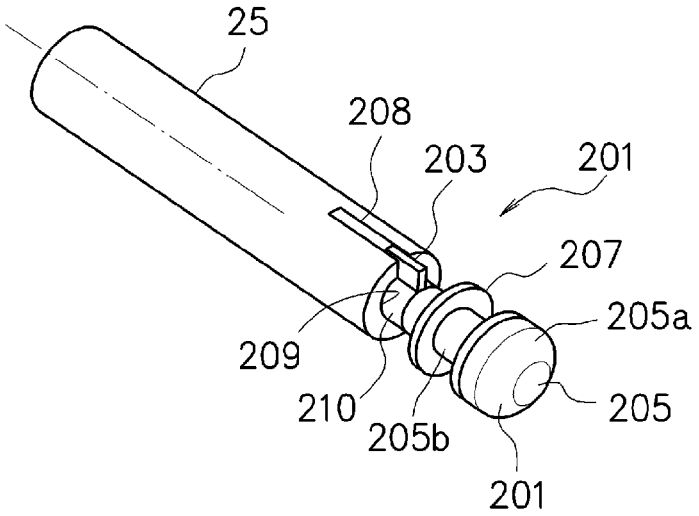
FIG. 8 is a perspective view illustrating an internal part structure example of the operating device of the electric outboard motor according to the second embodiment of the present invention.
Figure 9:
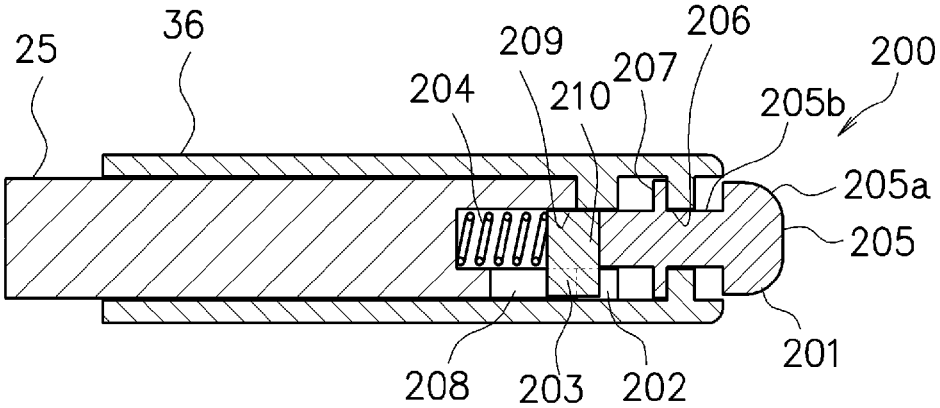
FIG. 9 is a cross-sectional view illustrating a working example in the operating device of the electric outboard motor according to the second embodiment of the present invention.
Figure 10:
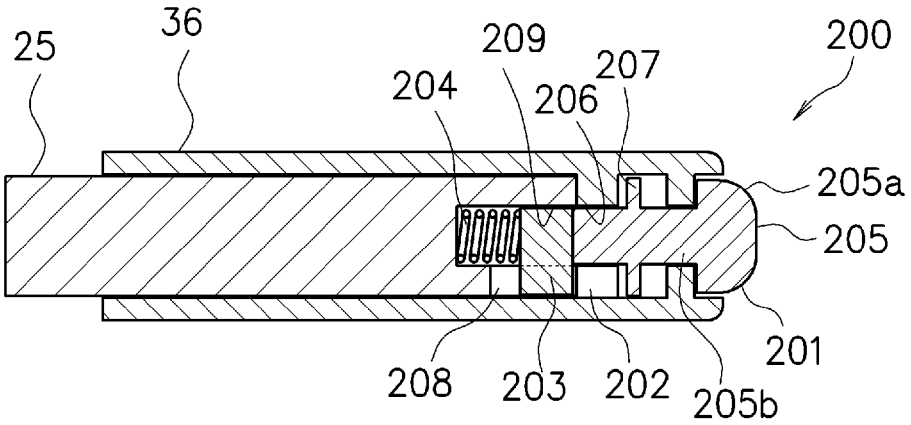
FIG. 10 is a cross-sectional view illustrating a working example in the operating device of the electric outboard motor according to the second embodiment of the present invention.

In a concrete structure of the accelerator grip fixing mechanism 201, as illustrated in FIG. 8 to FIG. 10, a slit-shaped key groove 202 being an engaging part of the accelerator grip 36, a key 203 being a locking piece that is formed to enable an engaging position where the key 203 projects from a steering handle 25 to engage with the accelerator grip 36 to make the accelerator grip 36 incapable of pivoting and a releasing position where the engagement is released so as to enable the accelerator grip 36 to pivot by going backward from this engaging position to appear and disappear easily, a spring 204 being a biasing member that constantly biases the key 203 toward the engaging position, and a switch 205 being a lock releasing button that biases the key 203 toward the releasing position to release the fixation of the accelerator grip 36 are provided.

In this example, the switch 205 has a head portion 205*a* thereof disposed so as to project from an end portion of the accelerator grip 36, and has a shaft portion 205*b* thereof slide-guided by a guide hole 206 formed in the accelerator grip 36.

Incidentally, to the switch 205, a stopper 207 that regulates a sliding movement of the switch 205 is attached.

The key 203, as illustrated in FIG. 8, is formed into a thin plate shape along the axial direction of the accelerator grip 36, and in the steering handle 25, a slit-shaped key groove 208 that slidably engages with the key 203 is formed. Incidentally, FIG. 8 and FIG. 9 and FIG. 10 are illustrated in a manner that the upper and lower relationship with FIG. 8 and the upper and lower relationship with FIG. 9 and FIG. 10 are reversed. The key 203 is provided on an outer peripheral portion of a boss portion 210 slide-guided by the guide hole 206 and a guide hole 209 formed in the steering handle 25 to project in the radial direction.

In the second embodiment, when in neutral (FIG. 7 to FIG. 9), the key 203 engages with both the key groove 202 and the key groove 208. With regard to the key 203, the boss portion 210 is biased outward in the axial direction by resilient force of the spring 104, so that as long as the switch 205 is not operated, the accelerator grip 36 is fixed to a lock state. Thereby, the accelerator grip 36 does not start to move from the neutral position accidentally and unintended erroneous operations can be prevented securely, resulting in that high safety is guaranteed.

On the other hand, when the switch 205 is pressed in against the resilient force of the spring 204, as illustrated in FIG. 10, the key 203 slides out from the key groove 202 and the engagement of the both is released. This lock release enables the accelerator grip 36 to pivot, and when the accelerator grip 36 pivots in a predetermined one direction or the other direction in this lock release state, the electric motor 21 is normally rotated or reversely rotated to enable a boat to move forward or backward.

When the accelerator grip 36 is returned to the neutral position from a normal pivot or reverse pivot position, the key 203 engages with the key groove 202 by itself at the neutral position and the accelerator grip 36 is fixed to the lock state again. Also in this case, the accelerator grip 36 is returned to the neutral position by itself, so that it is possible to extremely easily and securely perform determination of the neutral position. Further, there is no case that the accelerator grip 36 pivots passing through the neutral position, and the accelerator grip 36 stops at the neutral position definitely, so that erroneous operations such as an accidental pivot in the opposite direction can be prevented.

In the second embodiment in particular, the switch 205 is formed on the tip portion of the accelerator grip 36 to be able to project and sink easily in the axial direction of the steering handle 36.

Thereby, a boat operator can perform the operation of the accelerator grip fixing mechanism 201 by one hand in a state of gripping the accelerator grip 36. Unlike the case where the lock releasing button is operated by the hand on the side opposite to the one hand, the boat operator can directly perform an accelerator operation without changing his/her posture, and thus can concentrate on the boat moving direction.

In the foregoing, the present invention has been explained together with the various embodiments, but the present invention is not limited only to these embodiments, and changes and the like are possible within the scope of the present invention.

In the above-described embodiments, the example of the electric outboard motor has been explained, but the present invention is not limited to this, and is effectively applicable also to an outboard motor mounted with a gasoline engine with a tiller handle.

INDUSTRIAL APPLICABILITY

According to the present invention, it is possible to provide an operating device of an electric outboard motor that by accurate and smooth boat operation, secures higher safety and also achieves extremely excellent operationality.

The invention claimed is:

1. An operating device of an electric outboard motor designed that a steering bar-shaped handle projecting forward is provided and is pivotally supported on a hull to be able to steer right and left, a propeller is driven by an electric motor driven by power supplied from a power supply, and on a tip portion of the steering bar-shaped handle, an accelerator grip that is made to pivot on an axial center normally and reversely from a neutral position to adjust a rotation direction of the electric motor and an amount of power to be supplied to the electric motor according to a pivotal direction and a pivot amount is provided, the operating device comprising:

in the accelerator grip or in the vicinity of the accelerator grip, an accelerator grip fixing mechanism that fixes a pivot position of the accelerator grip at the neutral position to be able to release the fixation easily.

2. The operating device of the electric outboard motor according to claim 1, wherein the accelerator grip fixing mechanism comprises:

an engaging part of the accelerator grip;

a locking piece that is formed to enable an engaging position where the locking piece projects from the tip portion of the steering bar-shaped handle to engage with the accelerator grip to make the accelerator grip incapable of pivoting and a releasing position where the engagement is released so as to enable the accelerator grip to pivot by going backward from the engaging position to appear and disappear easily;

a biasing member that constantly biases the locking piece toward the engaging position side; and a lock releasing button that biases the locking piece toward the releasing position side to release the fixation of the accelerator grip.

3. The operating device of the electric outboard motor according to claim 2, wherein the lock releasing button in the accelerator grip fixing mechanism is projectingly provided on an outer peripheral surface of the accelerator grip and is formed to be able to project and sink easily in a radial direction of the accelerator grip.

4. The operating device of the electric outboard motor according to claim 3, wherein the lock releasing button in the accelerator grip fixing mechanism is disposed on a lower surface of the accelerator grip at a neutral position.

5. The operating device of the electric outboard motor according to claim 2, wherein the lock releasing button in the accelerator grip fixing mechanism is formed on a tip portion of the accelerator grip to be able to project and sink easily in an axial direction of the steering bar-shaped handle.

* * * * *